US007415804B2

(12) United States Patent
Coombs et al.

(10) Patent No.: US 7,415,804 B2
(45) Date of Patent: Aug. 26, 2008

(54) ISULATED CONCRETE FORM HAVING WELDED WIRE FORM TIE

(76) Inventors: Jerry D. Coombs, 1710 Stonecrest Trail, Wylie, TX (US) 75098; Andrew M. Horgan, 1009 Green St., Durham, NC (US) 27701; David W. Watson, Box 176, Tijeras, NM (US) 87059; Patrick C. Murphy, 4527 Sunningdale Ave., NE., Albuquerque, NM (US) 87110

( * ) Notice: Subject to any disclaimer, the term of this patent is extended or adjusted under 35 U.S.C. 154(b) by 556 days.

(21) Appl. No.: 10/656,359

(22) Filed: Sep. 4, 2003

(65) Prior Publication Data

US 2004/0045237 A1 Mar. 11, 2004

Related U.S. Application Data

(60) Provisional application No. 60/408,859, filed on Sep. 5, 2002.

(51) Int. Cl.
*E04B 2/86* (2006.01)

(52) U.S. Cl. ..... 52/426; 52/309.2; 52/431

(58) Field of Classification Search ..... 52/309.11, 52/426, 383, 565, 503, 664, 649.1, 309.2, 52/309.12, 309.15, 309.17, 431, 432, 442
See application file for complete search history.

(56) References Cited

U.S. PATENT DOCUMENTS

| | | | | |
|---|---|---|---|---|
| 3,552,076 A | | 1/1971 | Gregori | |
| 3,788,020 A | | 1/1974 | Gregori | |
| 4,133,156 A | * | 1/1979 | Unger | 52/426 |
| 4,223,501 A | | 9/1980 | DeLozier | |
| 4,229,920 A | | 10/1980 | Lount | |
| 4,285,181 A | * | 8/1981 | Van Loghem et al. | 52/405.4 |
| 4,439,967 A | | 4/1984 | Dielenberg | |
| 4,516,372 A | | 5/1985 | Grutsch | |
| 4,698,947 A | | 10/1987 | McKay | |
| 4,860,515 A | | 8/1989 | Browning, Jr. | |
| 4,866,891 A | | 9/1989 | Young | |
| 4,879,855 A | | 11/1989 | Berrenberg | |
| 4,888,931 A | * | 12/1989 | Meilleur | 52/426 |
| 4,889,310 A | | 12/1989 | Boeshart | |
| 4,967,528 A | * | 11/1990 | Doran | 52/309.12 |
| 4,972,646 A | * | 11/1990 | Miller et al. | 52/293.1 |
| 4,999,965 A | * | 3/1991 | Schmidgall et al. | 52/684 |

(Continued)

FOREIGN PATENT DOCUMENTS

WO WO 02/33184 A2 4/2002

OTHER PUBLICATIONS

"BecoWallform", Permanent Insulated Formwork System with Wallblock graphics: 1101 Wallblock 250 System; Wallform 250 System; Wallform 313 System; Wallform 375 System; and Wallform 438 System.

*Primary Examiner*—M. Safavi

(57) ABSTRACT

An insulating concrete form with two opposing panels, each panel having on each end thereof both a tongue and a groove for interconnecting with a similar form, the tongues and grooves positioned such that a similar form may be reversibly positioned and still interconnected, the opposing panels on each form joined by a plurality of metal wire ties with both horizontal and vertical members, preferably welded one to another, with each horizontal wire bent to form a right angle on each end with a metal attachment strip disposed within such right angle.

8 Claims, 11 Drawing Sheets

U.S. PATENT DOCUMENTS 5,014,480 A 5/1991 Guarriello et al.
5,123,222 A 6/1992 Guarriello et al.
5,140,794 A * 8/1992 Miller ..... 52/426
5,428,933 A 7/1995 Philippe
5,459,971 A 10/1995 Sparkman
5,465,542 A 11/1995 Terry
5,566,518 A 10/1996 Martin et al.
5,568,710 A * 10/1996 Smith et al. ..... 52/426
5,596,855 A 1/1997 Batch
5,625,989 A 5/1997 Brubaker et al.
5,701,710 A * 12/1997 Tremelling ..... 52/426
5,709,060 A * 1/1998 Vaughan et al. ..... 52/426
5,735,093 A 4/1998 Grutsch
5,771,648 A * 6/1998 Miller et al. ..... 52/426
5,809,728 A 9/1998 Tremelling
5,845,449 A 12/1998 Vaughan et al.
5,852,907 A 12/1998 Tobin et al.
5,887,401 A 3/1999 Moore, Jr.
5,896,714 A 4/1999 Cymbala et al.
6,070,380 A * 6/2000 Meilleur ..... 52/309.7
6,314,697 B1 11/2001 Moore, Jr.
6,412,245 B1 * 7/2002 Lane et al. ..... 52/586.1
6,536,172 B1 3/2003 Amend
6,647,686 B2 * 11/2003 Dunn et al. ..... 52/426
6,681,539 B2 * 1/2004 Yost et al. ..... 52/309.11
6,698,710 B1 * 3/2004 VanderWerf ..... 249/216

* cited by examiner

ISULATED CONCRETE FORM HAVING WELDED WIRE FORM TIE

CROSS-REFERENCE TO RELATED APPLICATIONS

This application claims the benefit of the filing of U.S. Provisional Patent Application Ser. No. 60/408,859, entitled "Insulated Concrete Form and Welded Wire Form Tie", filed on Sep. 5, 2002, and the specification thereof is incorporated herein by reference.

BACKGROUND OF THE INVENTION

1. Field of the Invention (Technical Field)

The present invention relates to a horizontally reversible insulating concrete form with opposing panels connected by wire ties, preferably welded wire ties with a metal sheet attachment stud, used to make concrete structures.

2. Description of Related Art

Traditional concrete walls in building construction are generally made by setting up two parallel form walls and pouring concrete into the space between the forms. After the concrete hardens, the builder then removes the forms, leaving the cured concrete wall.

This common prior art technique has significant drawbacks. The resulting wall is not insulated, and significant labor is required to remove the forms after the concrete cures or hardens.

Techniques have developed for forming modular concrete walls that use a foam insulating form material, generally referred to as "insulating concrete forms" or by the acronym "ICF". Using modular forms, which are available in different sizes, walls are set up. Most insulating concrete forms are composed of two parallel panels, forming an exterior and interior wall panel, with ties, bridges or other connecting components holding the two panels in place relative to each other while concrete is poured into the cavity between the panels. The insulating form panels remain in place after the concrete cures. Thus no labor is required to either remove forms or add insulation, resulting in substantial efficiency. In most cases, the insulation of the form provides adequate insulation for the building, so that no additional insulation is required.

Insulating concrete forms are manufactured from a polymeric material, often polyurethane or polystyrene, which is expanded and formed within a mold to yield a rigid, low-density foamed plastic form having vertical and/or horizontal cavities to be filled with wet concrete. U.S. Pat. No. 3,552,076, entitled Concrete Form to Gregori, and U.S. Pat. No. 3,788,020, entitled Foamed Plastic Concrete Form With Fire Resistant Tension Member, also to Gregori, are two early patents that both teach methods whereby polystyrene foam is molded to yield a concrete form.

The construction industry has incorporated several means of attaching finishing materials to the outer sides of these molded construction forms after the concrete within the cavities has set. One such method has been to glue the paneling, sheetrock, or other suitable finishing materials to the outer surfaces of the completed form. Additionally, outer finishing materials may be rigidly attached using a penetrating device through the outer molded form to the cured concrete or other building material inside the form. Another method to attach finishing materials is to glue or nail furring strips on the outer surfaces of the forms. Gluing the furring strips to the foam forms require construction adhesive, and nailing the furring strips or the finishing materials to the outer sides of the forms require that special concrete nails be used. The application of these concrete nails, moreover, must be accomplished at a critical time during the curing of the concrete. Then, the finishing materials are nailed or screwed onto the furring strips.

Another approach to concrete forms is disclosed in U.S. Pat. No. 4,223,501, entitled Concrete Form, to DeLozier. This patent teaches a method whereby a one piece transverse connecting member is embedded in the polystyrene concrete form taught in the Gregori patent. The connecting member has attachment flanges extending at right angles which extend near the outer surfaces of the form.

U.S. Pat. No. 4,879,855 entitled Attachment and Reinforcement Member for Molded Construction Forms, to Berenberg, discloses an attachment and reinforcement tie for molded construction forms with a central portion of expanded steel in which the ends are bent to accommodate covering strips of solid galvanized steel. The tie is embedded in a molded construction form during the form's manufacture. The strips of the solid galvanized steel extend to the outer surfaces of the form and provide attachment surfaces while the central portion of expanded steel web reinforces the form and connects the two panels.

It is known to have a groove on one end of both panels in an ICF, with a corresponding tongue on the other end of the panels, such that two forms may be joined together in a horizontal plane by means of a tongue and groove attachment. Among other patents, U.S. Pat. Nos. 3,552,076, 3,788,020, 4,223,501, 4,698,947, 4,879,855, 5,459,871, 5,465,542, and 5,596,855 disclose forms of this type. Other patents disclose a shiplap joint on the ends of both panels in an ICF, as disclosed in U.S. Pat. Nos. 4,516,372 and 5,568,710. However, all such forms can only be interconnected in a horizontal dimension in a specific direction, and the forms are not reversible.

While many forms utilize a plastic tie, there are a few forms which utilize a metal tie, such as U.S. Pat. Nos. 4,879,855 and 5,568,710, which employ an expanded metal tie, U.S. Pat. Nos. 4,223,501 and 5,596,855, which employ perforated metal plates with comparatively small openings, and U.S. Pat. No. 4,967,528, which employs a metal wire requiring an external clip to fasten the wire to an external plate. However, all such forms have significant limitations. With most, the openings through the tie are sufficiently small so as to impede the free flow of concrete during pouring. With forms such as the '528 form, multiple parts are required, and the tie is limited to providing connection at the top and bottom of the form, and thus provides inadequate strength for many form heights.

There remains a need in the industry for an insulated concrete form with superior strength that provides minimal obstruction to concrete flow when pouring. In general, having a form with ties on close centers, such as every six or twelve inches, is preferable. However, if the tie component can obstruct the flow of concrete when being poured, void or vacant spots can result which can seriously weaken the resulting wall. There similarly remains a need in the industry for a form which is reversible such that it may be assembled in a horizontal dimension in any orientation, with no "inside" or "outside" orientation to the form.

BRIEF SUMMARY OF THE INVENTION

The invention provides an insulating concrete form. In one preferred embodiment, the form includes two opposing panels of a polymeric material, with the ends of each panel including both a tongue and groove positioned such that the forms are reversible in a horizontal orientation. In another preferred embodiment, the opposing panels are joined together by a plurality of welded wire ties, with both horizontal and vertical members, the horizontal members having a right angle bend at either end, with a metal attachment stud disposed within the right angle bend, the right angle bends and metal attachment studs being within the structures of the opposing panels.

The invention thus provides in one embodiment an insulating concrete form with first and second substantially opposing panels, each panel having a top surface, bottom surface, first end surface, second end surface, an exterior surface defining a wall and an interior surface for receiving concrete. The opposing panels are interconnected by at least two ties, each tie having a plurality of horizontal wires and a plurality of vertical wires, arrayed such that each horizontal wire in a tie touches and is fixed to each vertical wire in the tie.

The tie further includes at least three parallel horizontal wires arranged in a single plane, the wires spaced distances apart such that the total distance from the bottom-most horizontal wire to the top-most horizontal wire is less than the height of the two opposing panels, with each wire being of a length greater than the distance between the exterior surfaces of the two opposing panels, and with an equidistant right angle on each end of each horizontal wire, positioned such that each right angle bend is disposed between the exterior surface and the interior surface of a panel. There are also provided at least three parallel vertical wires arranged in a single plane, the wires spaced apart and arranged so as to be disposed within a distance less than the distance between the right angle bends on each end of the horizontal wires, with each wire being of a length at least equal to the total distance from the bottom-most horizontal wire to the top-most horizontal wire. The horizontal wires and vertical wires are disposed such that each horizontal wire touches and forms a right angle intersection with all vertical wires, and each vertical wire touches and forms a right angle intersection with all horizontal wires, with the wires being fixed one to the other at each intersection. A metal sheet is disposed within the interior of right angle on each end of the horizontal wires, with at least a portion of the metal sheet being substantially parallel to the exterior surface of the panel wherein such right angle is disposed. Each metal sheet is in contact with the each horizontal wire and fixed thereto. In a preferred embodiment, the wires are fixed at each intersection by means that includes a weld, and further the metal sheet is fixed to each horizontal wire by means that include at least one weld.

In the tie, each vertical wire can include a semicircular bend at the intersection with each horizontal wire, the circle defined by the semicircular bend having a radius approximately equal to the diameter of the horizontal wire. In this way the horizontal wires and vertical wires are substantially co-planar within the plane defined between the right angles on each end of the horizontal wires.

In one embodiment, the horizontal wires are spaced distances apart such that the total distance from the bottom-most horizontal wire to the top-most horizontal wire is between about 75% and about 95% of the height of the two opposing panels. The vertical wires are of a length between about 100% and about 110% of the total distance from the bottom-most horizontal wire to the top-most horizontal wire.

In a preferred embodiment, a portion of the metal sheet, and preferably the larger part of the metal sheet, is substantially perpendicular to the exterior surface of the panel wherein such right angle is disposed. In this way the metal sheet forms an attachment stud for attaching wall coverings and other structures by means of screws.

In the form, the first end surface and second end surface of the first panel and second panel have both a tongue and groove, disposed such that on the first end surface of the first panel the tongue is proximal the exterior surface and the groove proximal the interior surface and on the second end surface of the first panel the groove is proximal the exterior surface and the tongue proximal the interior surface. On the first end surface of the second panel the groove is proximal the exterior surface and the tongue proximal the interior surface and on the second end surface of the second panel the tongue is proximal the exterior surface and the groove proximal the interior surface. The panels are disposed such that the first end surface of the first panel opposes the first end surface of the second panel and the second end surface of the first panel opposes the second end surface of the second panel. By use of this structure two or more forms may be horizontally positioned and interlocked to form a planar surface by means of a joint formed by both a tongue and a groove on each panel of one form interconnecting with a groove and a tongue on each panel of another form, the forms being reversibly connectable such that the first end surface of the first and second panels of one form may be joined with either the first end surface or the second end surface of the first and second panels of another form.

The top surface of both the first and second panel can include either a tongue or a groove, with the bottom surface of the first and second panel having the complementary tongue or groove. In this way two or more forms may be vertically stacked and interlocked to form a planar surface by means of a joint formed by a single tongue on each panel of one form interconnecting with a single groove on each panel of another form.

A primary object of the present invention is to provide an ICF with a welded wire tie, the welded wire tie including at least three horizontal wire and three vertical wires, wherein each end of the horizontal wires are bent to form a right angle, with a steel strip disposed within the right angle, and forming an attachment stud for attaching wall coverings to the ICF.

Another object of the present invention is to provide an ICF which is reversible, such that either end of any form may be attached in a horizontal direction to either end of any other form.

Another object of the present invention is to provide an ICF which combines the advantages of a reversible form with a welded wire tie.

Another object of the present invention is to provide an ICF wherein each panel of the ICF includes both a tongue and a groove, thereby resulting in a more secure attachment between forms.

A primary advantage of the present invention is that the wire ties provide increased structural strength between the opposing panels of the ICF.

Another advantage of the present invention is that construction is simplified, in that there is no defined "inside" or "outside" on forms, and forms may be connected in a horizontal orientation such that either end of any ICF may be joined to either end of any other ICF.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

Figure 1:
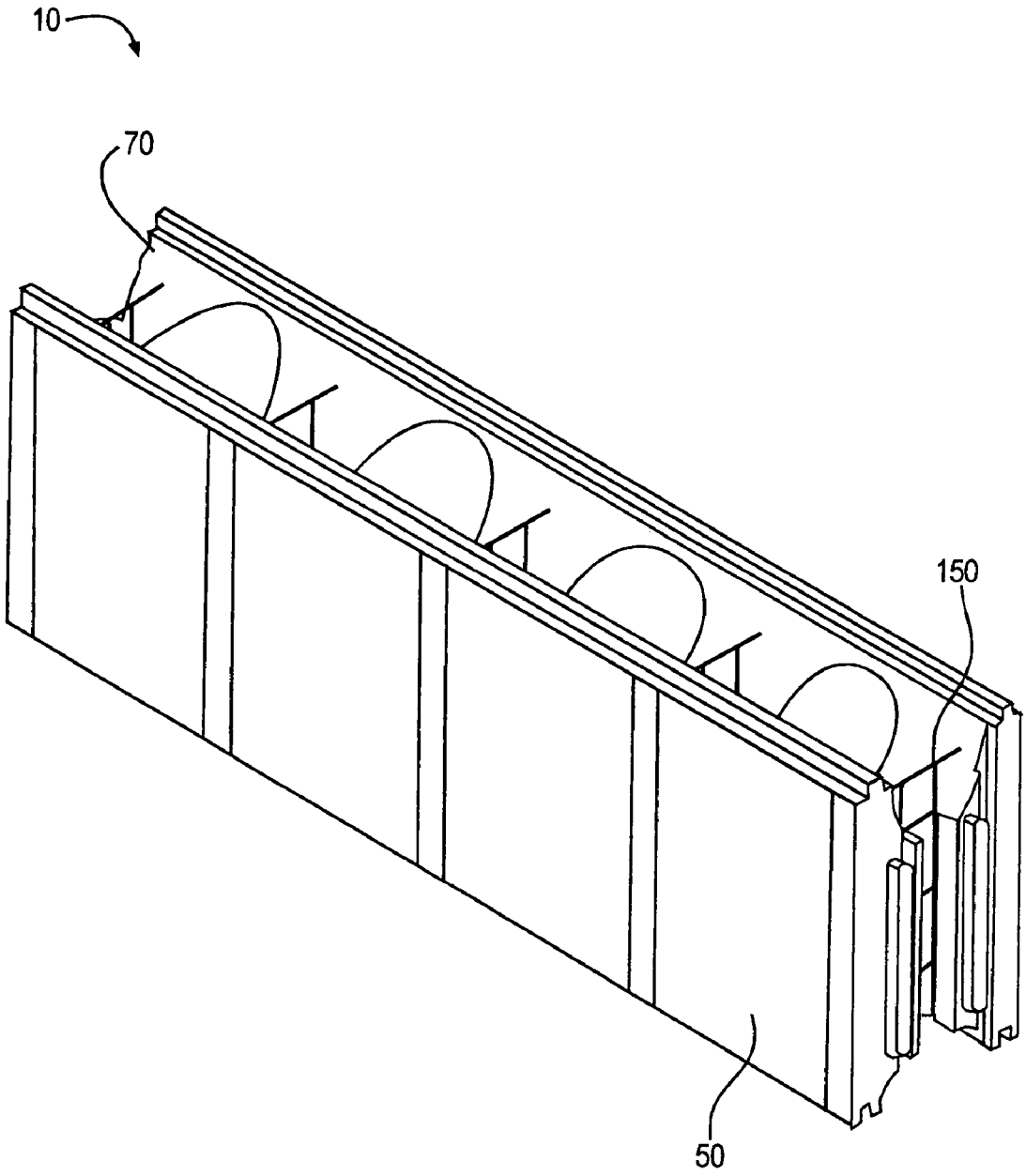
FIG. 1 is an illustration of a waffle grid form of the invention.

FIG. 1 depicts waffle grid form 10 of the invention, made of opposing panels 50 and 70 joined together by a plurality of metal ties 150. Panels 50 and 70 are preferably made of an insulating polymeric material, which is preferably a moldable polymeric material. In a preferred embodiment, panels 50 and 70 are made of an expanded polystyrene material, with a density of approximately 1.5 lbs. per cubic foot. Waffle grid form 10 may be provided in a variety of widths; in one embodiment, the form has an overall width of about 9.25 inches, with a maximum concrete core width of about 6 inches; in another embodiment, the form has an overall width of about 11 inches, with a maximum concrete core width of about 8 inches; and in yet another embodiment, the form has an overall width of about 14 inches, with a maximum concrete core width of about 10 inches. Waffle grid form 10 may be any convenient length suitable for use in construction; in one embodiment the form has a length of 48 inches. Similarly, the height may be selected such as to be suitable for use in construction; in one embodiment the form has a height of 16 inches. The external surface of panels 50 and 70 are substantially planar, with vertical grooves designating the position within the form of the attachment stud, also called a furring strip, forming a part of metal tie 150.

Figure 2:
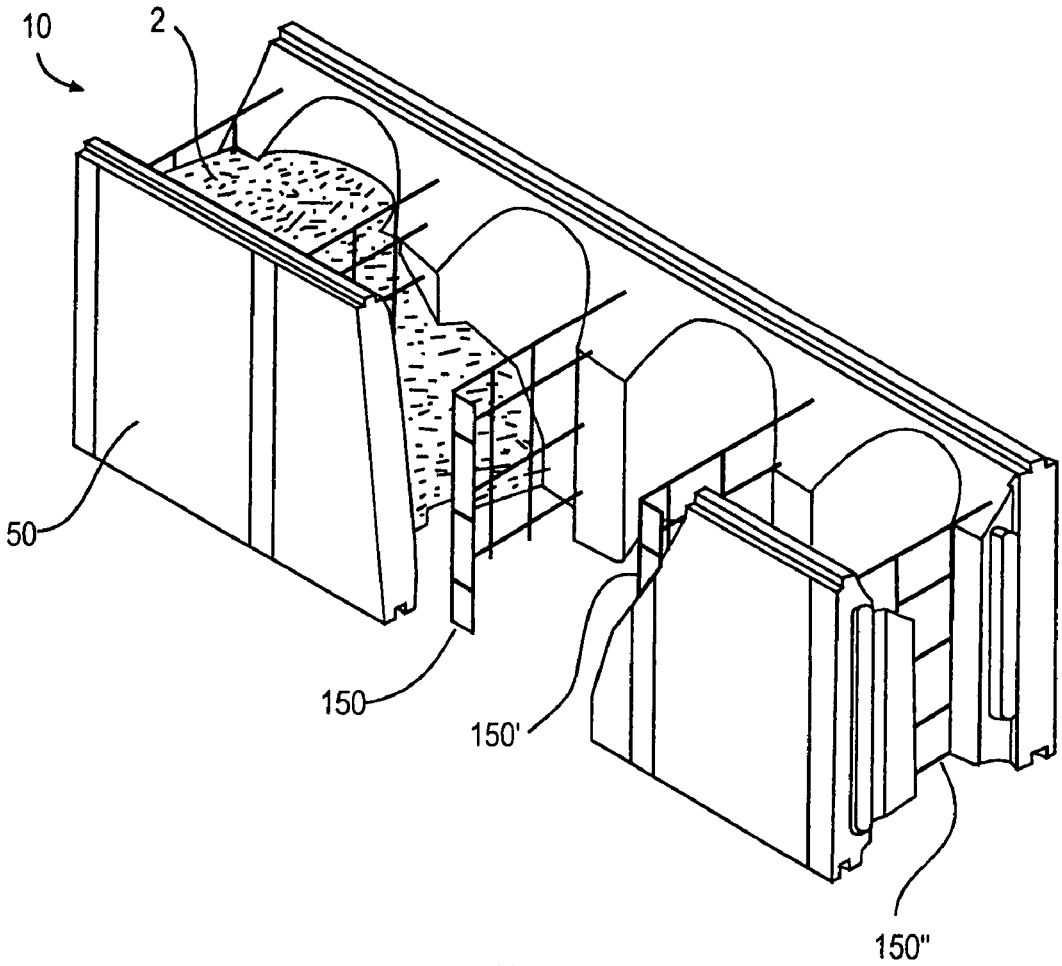
FIG. 2 is an illustration of a partially cutaway waffle grid form of the invention, showing the form partially filled with concrete with the tie and attachment stud illustrated.

FIG. 2 depicts partially cutaway waffle grid form 10, which form is partially filled with concrete 2, concrete 2 being a part of the completed wall, and not a part of form 10. FIG. 2 further depicts ties 150, 150', and 150" disposed within form 10. The ties 150, 150', and 150" are formed from a suitable gauge of steel wire, such as 11 gauge minimum thickness wire, with a steel attachment stud disposed within the right angle bend of horizontal wires of the ties. The steel attachment stud is formed of a suitable thickness steel sheet, such as about 22 gauge steel. It may be seen that the steel attachment stud is disposed within the wall of panel 50, such that the steel attachment stud is a determined distance from the exterior of panel 50, such as about one-half inch. The ties 150, 150', and 150", including the wires and steel attachment stud, may be galvanized. The interior of panels 50, 70 are shaped such that the concrete, when introduced, forms a "waffle grid" pattern, comprising a series of concrete posts and beams, connected with solid concrete webs. For example, waffle grid form 10 with an overall width of about 14 inches provides 10 inch solid concrete posts, connected with 3 ½ inch solid concrete webs.

Figure 3:
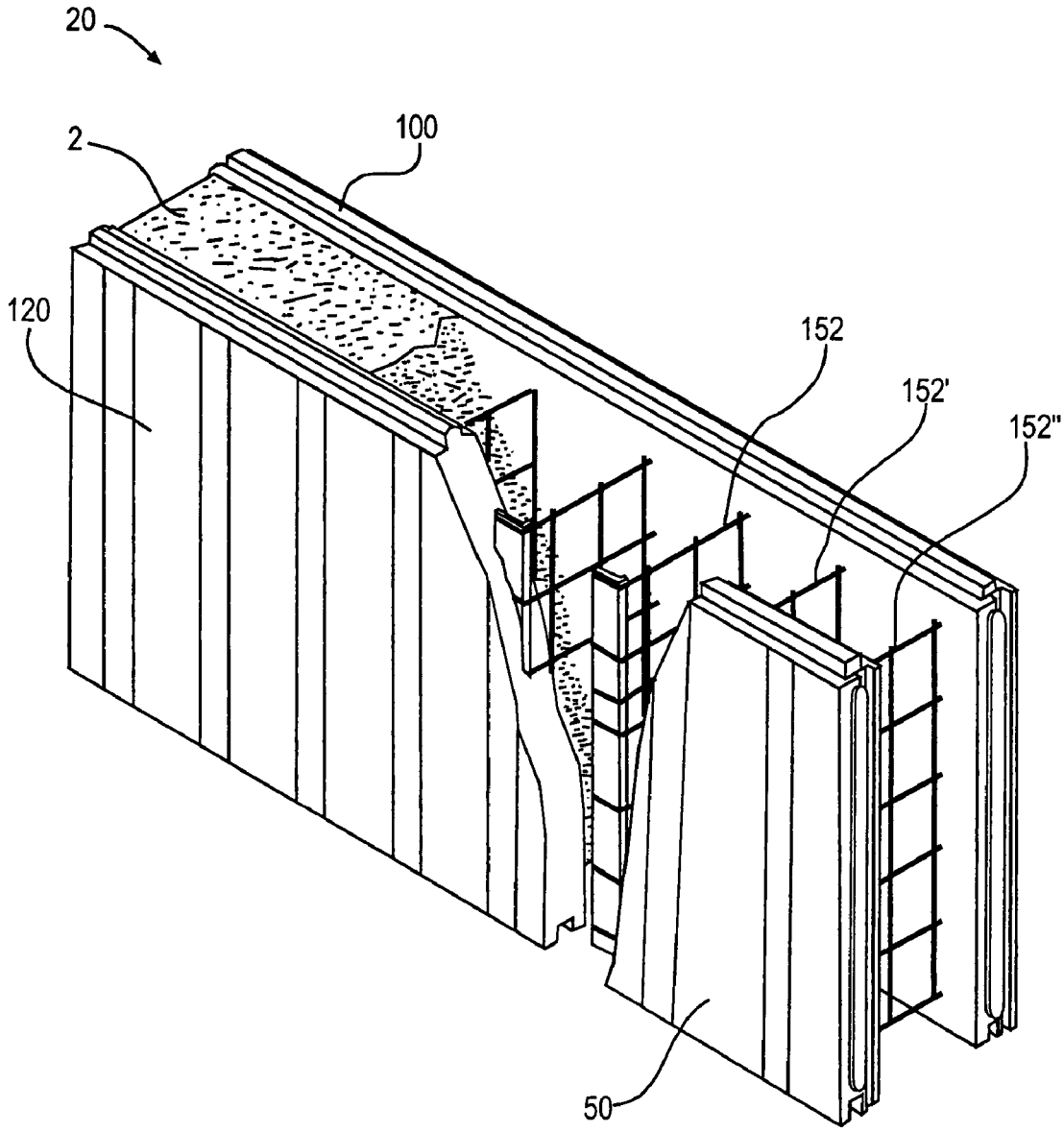
FIG. 3 is an illustration of a partially cutaway flat panel form of the invention; showing the form partially filed with concrete with the tie and attachment stud illustrated.

FIG. 3 depicts partially cutaway flat panel form 20 of the invention, made of opposing panels 100 and 120 joined together by a plurality of metal ties 152, 152', and 152", which form is partially filled with concrete 2, concrete 2 being a part of the completed wall, and not a part of form 20. Flat panel form 20 may be provided in a variety of widths; in one embodiment, the form has an overall width of about 11 inches, with a concrete core width of about 6 inches; in another embodiment, the form has an overall width of about 13 inches, with a concrete core width of about 8 inches. Flat panel form 20 may be any convenient length suitable for use in construction; in one embodiment the form has a length of 48 inches. Similarly, the height may be selected such as to be suitable for use in construction; in one embodiment form 20 has a height of 24 inches. In another embodiment, form 20 has a height of 12 inches.

In forms 10, 20 of FIGS. 1 to 3, metal ties 150 or 152, 152', and 152" are spaced on a standard and conventional distance on center; in one preferred embodiment of form 20, the metal ties are spaced every 6 inches on center. In a preferred embodiment of form 10, the metal ties are spaced every 12 inches on center. As shown in FIG. 4, the distance "a" is a set and equal distance, such that the center lines of attachment studs of metal ties 150, 150', and 150" are at an equal distance. As shown in FIG. 4, metal tie 150 may be reversed with respect to other metal ties, such as 150', so that the attachment studs remain on center without the metal tie 150 interfering with the tongue and groove members of form 10.

In FIG. 4, the cavity wall 54 depicts that portion of form 10 defining a concrete post, upon introduction of concrete, and cavity wall 52 depicts that portion of form 10 defining a concrete web, again upon introduction of concrete. Panel 50 includes, at one end, planar area 66, which planar area abuts against a like area of another form when two or more forms are joined together in horizontal orientation. Tongue 58 is adjacent to and of reciprocal shape with groove 60, with adjacent thereto being second planar area 56. The opposite end of panel 50 includes the same elements, but arranged such that groove 62 is opposite tongue 58, both disposed on the exterior side of panel 50, and tongue 64 is opposite groove 60, both disposed on the interior side of panel 50. Preferably grooves 60, 62 are of somewhat greater depth than the height of tongues 58, 64, such that the tongues fit within the grooves without binding or bottoming. In one embodiment, the grooves 60, 62 have a nominal depth of about 0.42 inches, while the tongues 58, 64 have a nominal height of about 0.37 inches. The width of grooves 60, 62 may be approximately equal to that of tongues 58, 64, thereby insuring a tight fit. Opposing panel 50 is panel 70, containing the same elements as panel 50. However, panel 70 is constructed such that groove 80 is the disposed on the exterior side of panel 70, while tongue 78 is adjacent thereto but disposed on the interior side of panel 70. Planar area 68 is provided on the exterior side of panel 70, while second planar area 76 is provided on the interior side. The opposite end of panel 70 includes the same elements, but arranged such that groove 82 is opposite tongue 78, both disposed on the interior side of panel 70, and tongue 84 is opposite groove 80, both disposed on the exterior side of panel 70. It may thus be seen that on form 10 panels 50, 70 are constructed such that at one end the outermost joining end element is a tongue and a groove, such as tongue 58 and groove 80, while at the opposite end the outermost joining end element position is reversed. In this way, the forms are reversible; that is, given a plurality of forms 10, such forms may be joined together in a horizontal dimension even though any single form is rotated 180°, and the forms still interconnect and join.

Figure 4A:
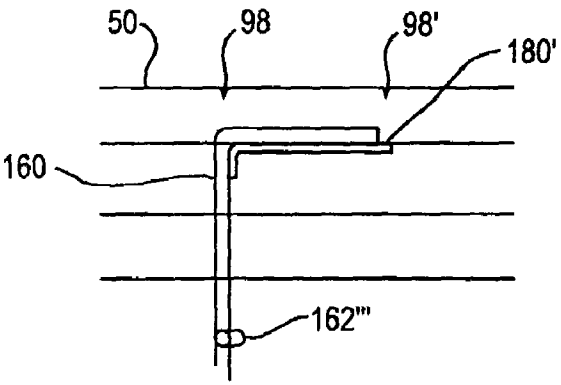
FIG. 4A is a detail view of the placement of the wire tie of the invention within the wall of a panel of the form of FIG. 4, illustrating placement of the attachment stud.
Figure 4:
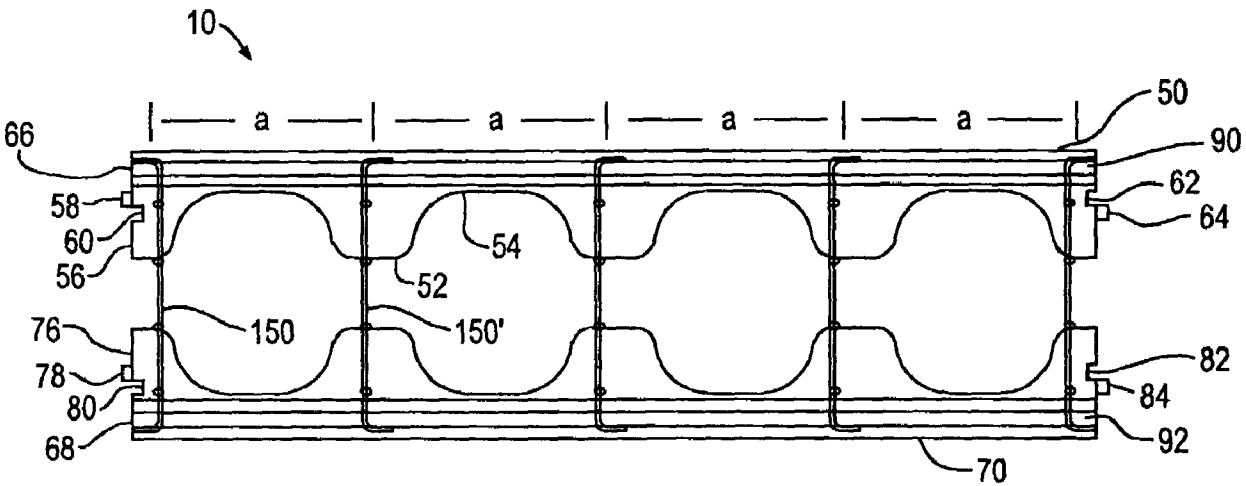
FIG. 4 is a top view of a waffle grid form of the invention, showing two opposing panels, with the interior cavity configured in a waffle structure, the two opposing panels joined by metal wire ties of the invention.

As shown in FIG. 4A, wire tie 150 includes horizontal wire 160 bent to form a right angle, and disposed therein metal attachment stud 180'. The tie is positioned within the form such that the exterior surface of wire 160 is embedded within the polymeric substrate of panel 50 a suitable distance, such as about one-half inch, with the position of metal attachment stud 180' within the form indicated on the exterior of panel 50 by means of grooves 98, 98'. In one preferred embodiment, the width of metal attachment stud 180', and thus the distance between grooves 98, 98', is about 1½ inches.

Figure 5:
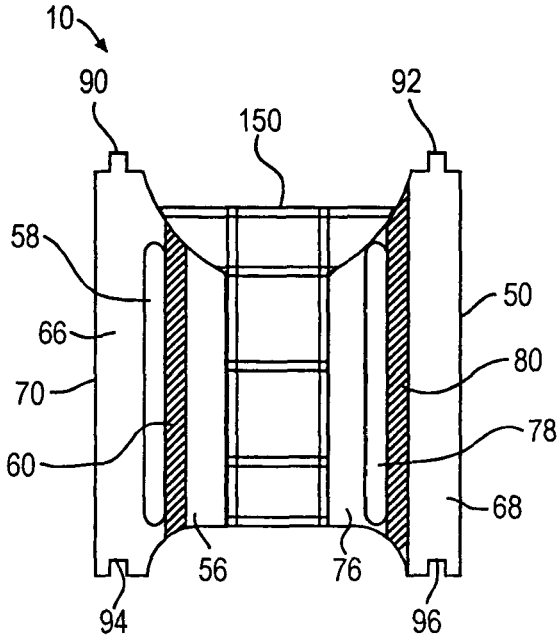
FIG. 5 is an end view of a waffle grid form of the invention, showing the end tongue and groove on each panel, with a groove disposed on the bottom of each panel and a tongue disposed on the top of each panel.
Figure 5A:
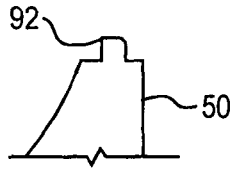
FIG. 5A is a detail view of the top tongue on a panel of the form of FIG. 5, showing a bevel on the tongue.

FIG. 5 depicts an end view of form 10, showing tongue 92 disposed on the top of panel 50, with groove 96 disposed on the bottom thereof, and corresponding tongue 90 and groove 94 on panel 70. Also shown is metal tie 150; it may thus be seen that metal tie 150 is a substantial portion of the height of panels 50, 70; in one preferred embodiment, panels 50, 70 have a height of 16 inches, while tie 150 has a height of 13 inches. Tongues 58, 78 are shown, and have a radius curve on the top and bottom of each, to permit facile introduction into the grooves, such as grooves 60, 80, which grooves run the height of the available distance of panels 50, 70. Planar areas 66, 68 are co-planar one with the other, and are further optionally co-planar with second planar areas 56, 76, which are also co-planar one with the other. FIG. 5A depicts a detail of the top of panel 50, showing tongue 92 having a slight exterior curve on the top outer corner, thereby facilitating joining together two forms in a vertical orientation.

Figure 6:
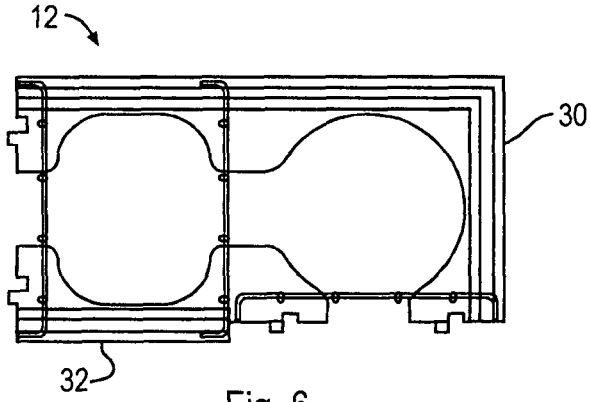
FIG. 6 is a top view of a right angle corner waffle grid form of the invention.
Figure 7:
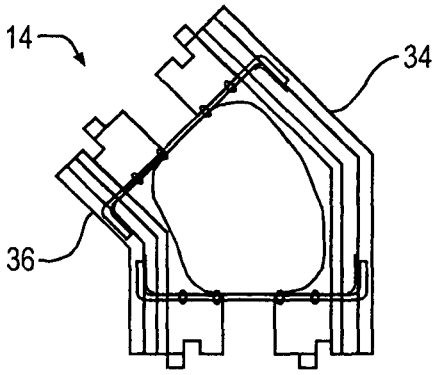
FIG. 7 is a top view of a forty-five degree angle corner waffle grid form of the invention.

FIGS. 6 and 7 depict respectively right angle waffle grid form 12, for a right angle corner in a wall made of forms 10, and forty-five degree angle waffle grid form 14, for a forty-five degree angle in a wall made of forms 10. Panel 30 includes a right angle turn, while the interior is a "stub" panel 32 which does not include a turn. Both panels 34, 36 include forty-five degree turns; as shown in FIG. 7, the tongues and grooves are arranged as in FIG. 4.

Figure 8:
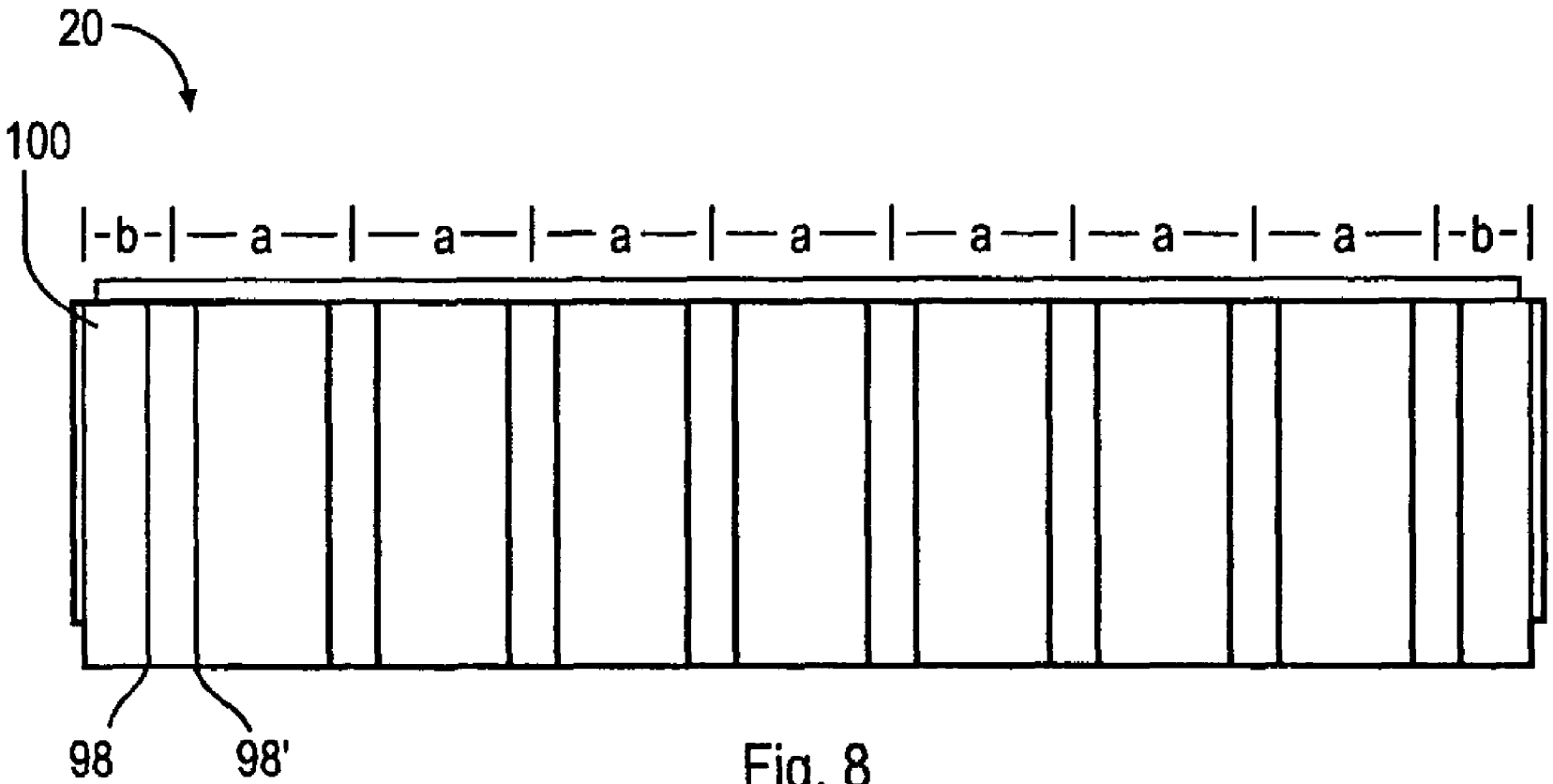
FIG. 8 is a side view of a flat panel form of the invention.
Figure 9:
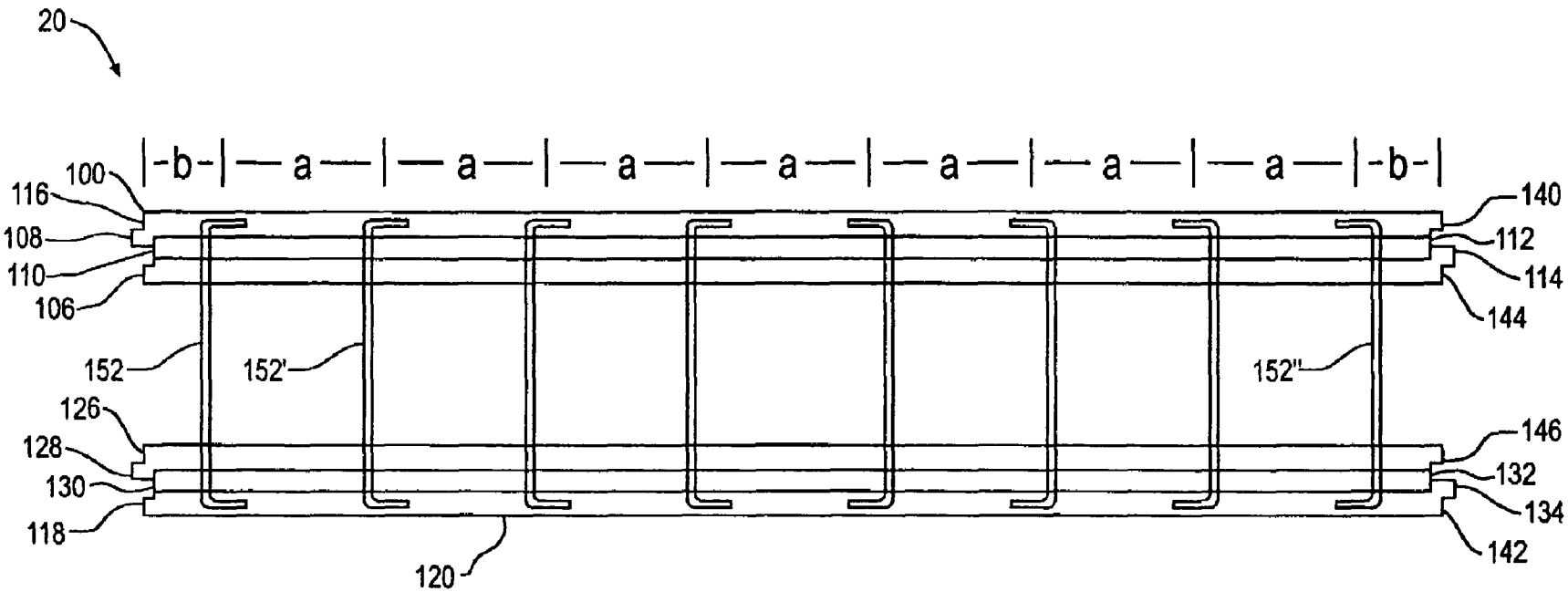
FIG. 9 is a top view of a flat panel form of the invention, showing two opposing panels, with the interior cavity configured in a flat structure, the two opposing panels joined by metal wire ties of the invention.
Figure 10:
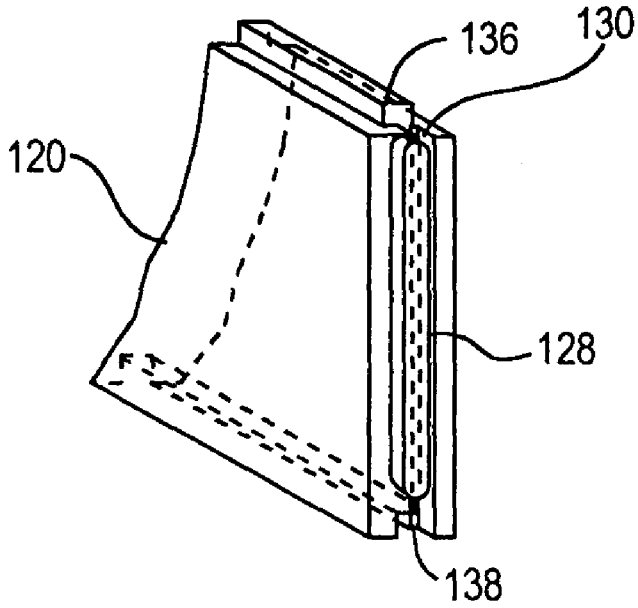
FIG. 10 is a detail drawing of the end of a panel of a flat panel form of the invention.
Figure 11:
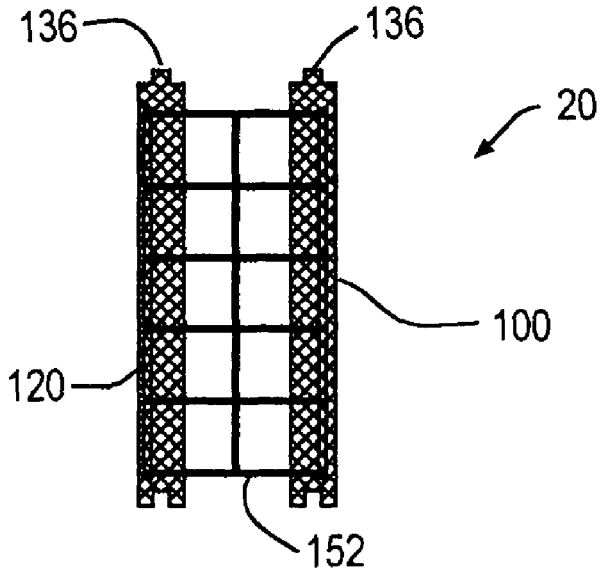
FIG. 11 is a cross-section view of a flat panel form of the invention.
Figure 14:
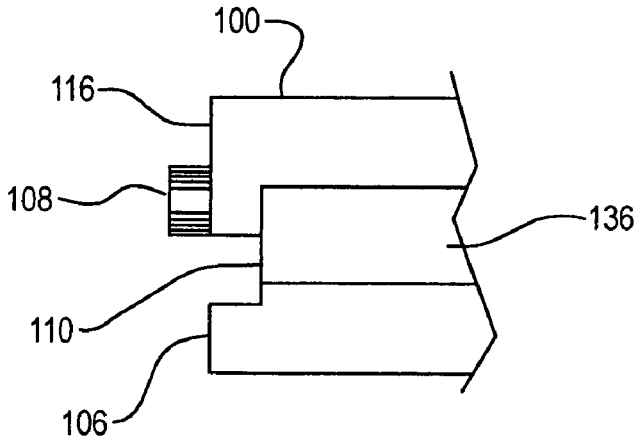
FIG. 14 is a detail top view of the end of a panel of a flat panel form of the invention.

FIG. 8 depicts a side view of flat wall form 20, showing the exterior of panel 100. Grooves 98, 98' mark, on the exterior of panel 100, the position within panel 100 of metal attachment stud 180 forming a part of tie 150. The distances "a" are all equal in FIGS. 8 and 9, with the distances "b" plus "b" equal to "a", such that when two or more forms are positioned in a horizontal direction, the distances between the centerlines of any two adjacent areas defined by grooves 98, 98' are each the same, including the distance between centerlines on two adjacent forms. As shown in FIG. 9, form 20 includes panels 100 and 120. Tongue 108 is disposed on the exterior side of panel 100, with groove 110 on the interior side; on the opposite end, opposing tongue 108 is groove 112, and opposing groove 110 is tongue 114. Planar area 116 is opposite corresponding planar area 140, and second planar area 106 is disposed opposite corresponding second planar area 144. Opposing panel 120 is complementary, such that groove 130 is on the exterior side of such panel, with tongue 128 on the interior, and opposing groove 130 is tongue 134, and opposing tongue 128 is groove 132. Similarly, planar area 118 is opposite corresponding planar area 142, and second planar area 126 is disposed opposite corresponding second planar area 146. Planar areas 116, 118 are co-planar one with the other, and are further optionally co-planar with second planar areas 106, 126, which are also co-planar one with the other. Panels 100, 120 are joined together by means of metal ties 152, 152', and 152"; as shown, tie 152" is reversed in orientation with respect to ties 152, 152'. FIG. 10 depicts a detail of the end of panel 120, showing tongue 136 disposed on the top thereof, with groove 138 on the bottom. Also shown is tongue 128, with the top and bottom thereof having a radius curve, to thereby engage more easily with a corresponding groove. Groove 130 adjoins tongue 128. The top view shown in FIG. 14 further depicts the radius curve on the top of tongue 108, and the relationship of the top of tongue 136 with respect to end groove 110. FIG. 11 is a cross-section of form 20; as shown therein tie 152 extends for very nearly the height of panels 100, 120. In one embodiment, panels 100, 120 are approximately 24 inches in height, while tie 152 is 21 inches in height.

Figure 12:
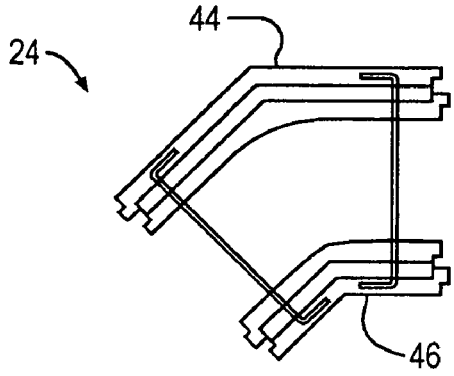
FIG. 12 is a top view of a forty-five degree angle corner flat panel form of the invention.
Figure 13:
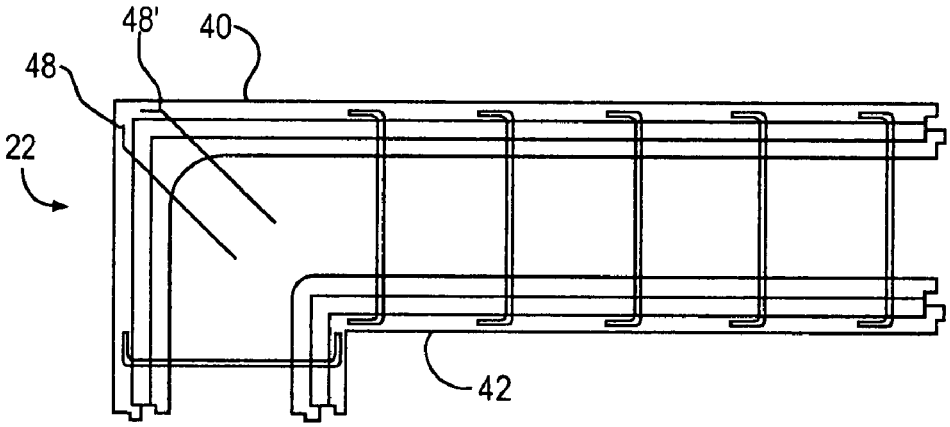
FIG. 13 is a top view of a right angle corner flat panel form of the invention.

FIG. 12 depicts forty-five degree angle form 24, for a forty-five degree angle in a wall made of forms 20. FIG. 13 depicts right angle form 22, for a right angle corner in a wall made of forms 20. Panels 40, 42 each include a right angle turn. Similarly, both panels 44, 46 include forty-five degree turns; as shown in FIGS. 12 and 13, the tongues and grooves are arranged as in form 20 of FIG. 9.

In form 22 of FIG. 13 there are depicted corner attachment studs 48, 48', providing a metal strip on each plane adjacent the intersection as shown. The corner attachment studs 48, 48' thus provide an attachment stud of a dimension substantially the same as that of metal strip 180, and arranged in the same orientation. The corner attachment studs 48, 48' can further include a portion that extends into the cavity, as shown, for securing the corner attachment studs 48, 48' to the concrete. The portion extending into the cavity may be made of expanded metal, with the portion corresponding to metal strip 180 consisting of a solid metal sheet. While corner attachment studs 48, 48' are shown only in connection with form 22, it is to be understood that similar corner attachment studs may be employed in any corner form, including forms 12, 14 or 14.

Figure 15:
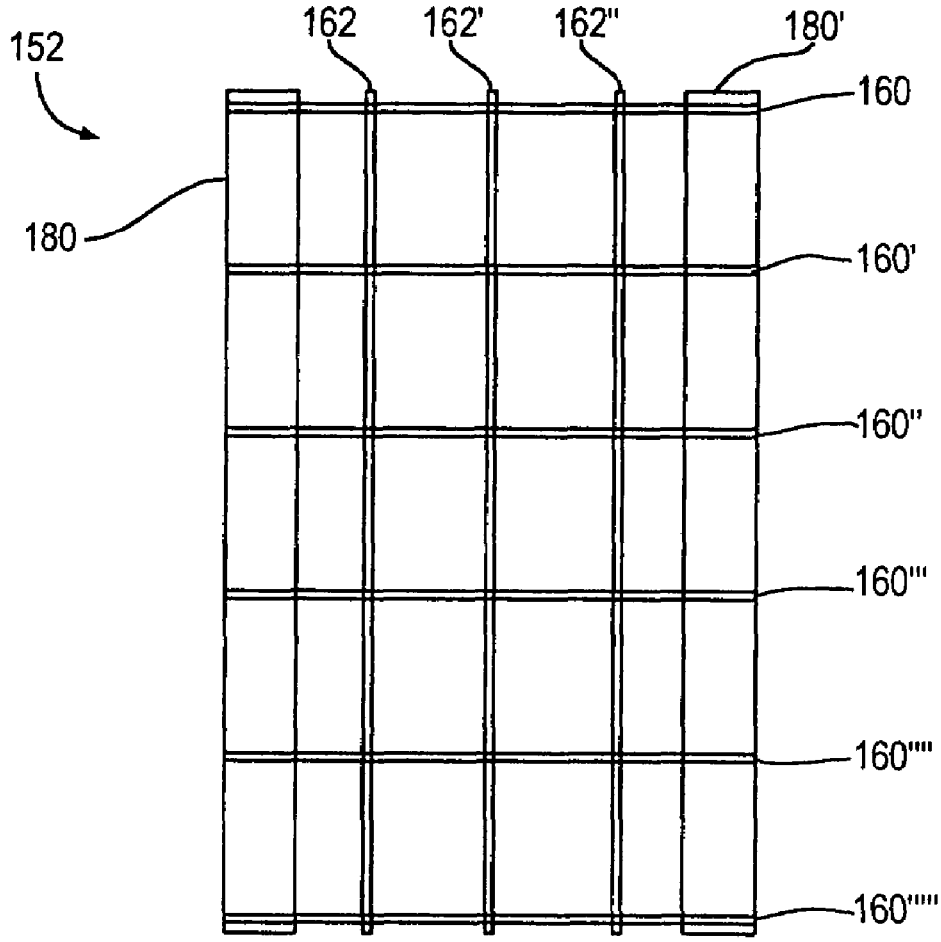
FIG. 15 is a front view of a metal wire tie of the invention, prior to introduction of right angle bends at either horizontal end of the tie.
Figure 16:
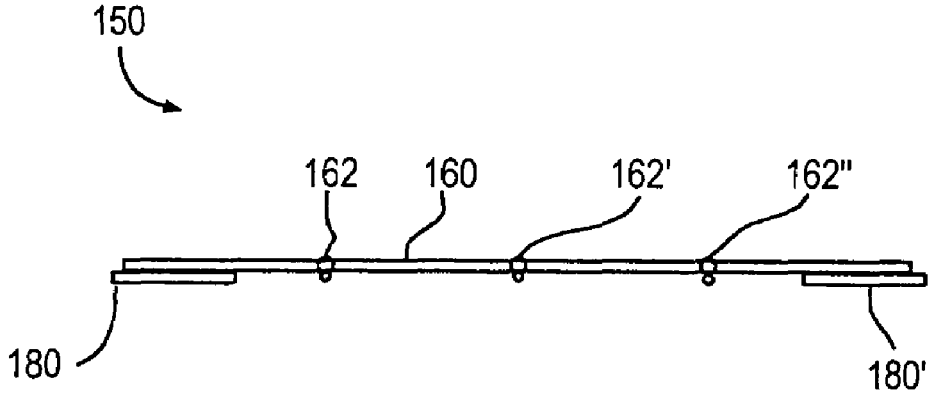
FIG. 16 is a top view of a metal wire tie of the invention, prior to introduction of right angle bends at either horizontal end of the tie.
Figure 17:
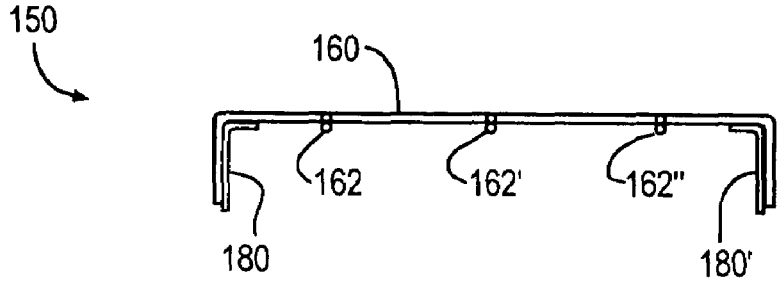
FIG. 17 is a top view of a metal wire tie of the invention, depicting the right angle bends at both horizontal ends of the tie.
Figure 18:
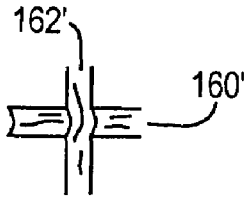
FIG. 18 is a detail view of an interconnection of a horizontal and vertical wire of the metal wire tie, wherein the vertical wire has a semicircular bend at the intersection with the horizontal wire, the circle defined by the semicircular bend having a radius approximately equal to the diameter of the horizontal wire, such that the horizontal wire and vertical wire are substantially co-planar.
Figure 19:
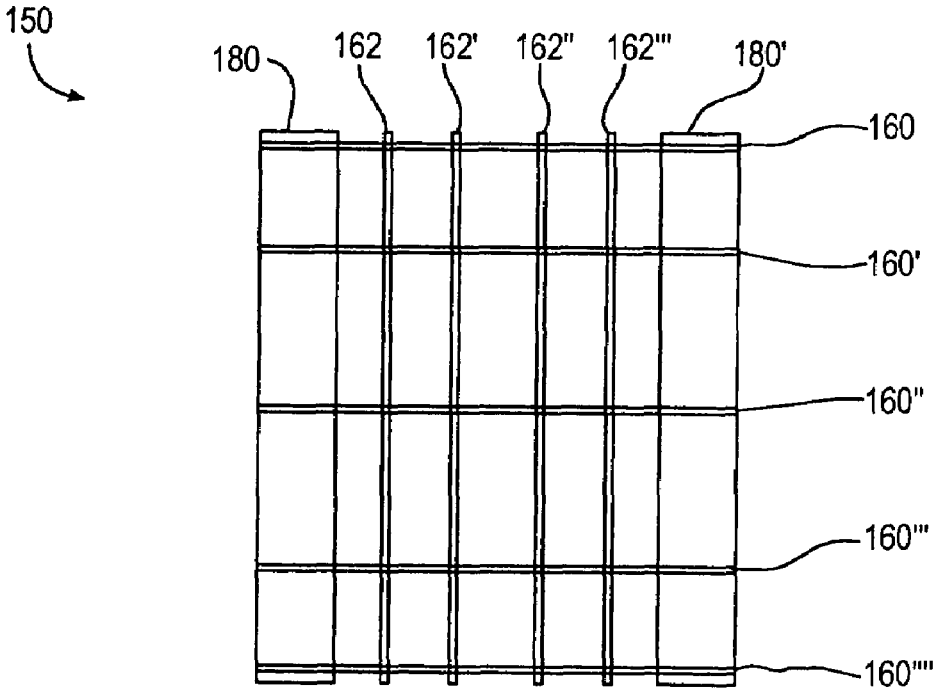
FIG. 19 is a top view of an alternative configuration of the metal wire tie of the invention, prior to introduction of right angle bends at either horizontal end of the tie.

FIG. 15 depicts tie 152, made up of a plurality of horizontal metal wires 160, 160', 160", 160''', 160'''', 160''''', and vertical wires 162, 162', 162". The horizontal and vertical wires are at right angles, and each wire is affixed to each other wire at the intersection point thereof. Such affixing or joining may be by any means, including mechanical fasteners, adhesives or the like; in a preferred embodiment the wires are welded one to the other. The wires are of a suitable diameter to provide the requisite structural strength and integrity; in a preferred embodiment the diameter of the wires range from about 0.10 inches to about 0.15 inches, and most preferably about 0.12 inches. Metal attachment studs 180, 180' are affixed or joined to horizontal wires 160, 160', 160", 160''', 160'''', 160''''' by any means, including mechanical fasteners, adhesives or the like; in a preferred embodiment the studs are welded to the horizontal wires; preferably welded to each horizontal wire in two spots. The tie 152 may be galvanized or otherwise coated to provide protection against rust or other corrosion prior to use of the form. Each of horizontal metal wires 160, 160', 160", 160''', 160'''', 160''''' are co-planar one with the other, and similarly each of vertical wires 162, 162', 162" are co-planar one with the other. As is shown in FIG. 18, it is possible and contemplated that vertical wire 162' (and all other vertical wires) has a semicircular bend at the intersection with horizontal wire 160' (and all other horizontal wires) the circle defined by the semicircular bend having a radius approximately equal to the diameter of the horizontal wire, such that horizontal wire 160' and vertical wire 162' (and all other vertical and horizontal wires) are substantially co-planar. The semicircular bend may be a crimp, and may be formed by pressing means, including pressing and forming the bend or crimp in the vertical wire using the horizontal wire. Alternatively, the horizontal wires and vertical wires may constitute two separate planes, with each horizontal wire contacting each vertical wire, and vice versa. Alternative configuration metal tie 150 is shown in FIG. 19, depicting a plurality of horizontal metal wires 160, 160', 160", 160''', 160'''', and vertical wires 162, 162', 162", 162''', and metal attachment studs 180, 180'. A top view of tie 150 is shown in FIG. 16; it may be seen that in that embodiment metal attachment studs 180, 180' extend slightly beyond the end of horizontal wire 160. The length of tie 150, prior to introduction of the right angle bends, is greater than the width of corresponding form 10; as shown in FIG. 17 the ends of wire 160, and optionally including a portion of metal attachment studs 180, 180', are bend in a right angle, such that tie 150 with right angle bends is wholly disposed within a distance slightly less than the width of form 10, as shown in FIG. 4. Preferably the tie 150 is of a length such that metal attachment studs 180, 180' lie a fixed distance below the external surface of panels 50, 70, such as about one-half inch below the surface.

Figure 20:
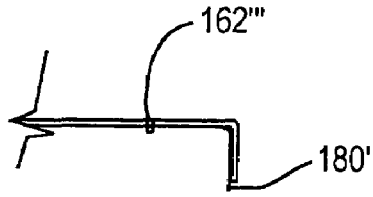
FIG. 20 is a detail top view of a right angle bend at one horizontal end of a metal wire tie.

Metal attachment studs 180, 180' are preferably metal strips of a steel metal of suitable gauge for use with standard dry-wall screws, self-tapping screws or sheet metal screws. In one embodiment, a 22 gauge strip is employed. Studs 180, 180' may similarly be galvanized, and preferably are galvanized together with the vertical and horizontal wires. It may be seen, as shown in FIGS. 17 and 20, that the metal attachment stud 180' is disposed within the interior of the horizontal wires 160, 160', 160", 160''', 160'''', and thus the horizontal wires serve to secure and hold in place metal attachment stud 180' during use.

The invention thus provides insulating concrete forms consisting of two panels of expanded polystyrene or other insulating polymeric material tied together with a form tie of metal, preferably steel, which provides an attachment surface which runs parallel to the surface of each panel either directly on the surface of the form, or is submerged within the structure of the panel, such as about one-half inch from the exterior surface of the panel. The foam panels are preferably molded around the ties, so that the ties become an integral part of a molded form. Alternatively the ties are separate pieces used to assemble two independently formed or cut panels of foam to make a form, such as assembly in the field as walls are being constructed.

Three key functions of the form ties are provided: to maintain the integrity of the form during the placement of concrete by preventing the foam panels from deforming or separating, to provide ample space for concrete to flow through and around the tie to facilitate the formation of a solid concrete wall, and to provide a secure surface for the mechanical attachment of interior and exterior wall coverings. Each form tie consists of welded wire, such as welded galvanized steel wire, of any specified diameter, spaced at regulated intervals, depending on the form size and thickness. The width and height of the steel grid is dependent on the height and thickness of the expanded polystyrene (EPS) form.

In one embodiment on each vertical edge of the grid is a galvanized steel strip, approximately 1¾ inches to 2 inches in width, which is bent in the vertical plane at a right angle (a 90° angle) to align the surface of the strip in a parallel plane to the exterior surface of the EPS form. This galvanized steep strip forms an attachment stud, providing a secure surface for the mechanical attachment of interior and exterior wall coverings. The strip is bent such that at least part of the strip, and preferably a majority of the strips remain in the same plane as the wire grid. The bend in the steel creates a much higher moment of inertia and section modulus, which adds significant strength to the strip itself, and to the entire tie assembly. The horizontal wires of the tie grid extend to the outside of the bend, which restrains the steel strip in case of separation of the assembly and reinforces the "pull-out" strength of the strip when wall coverings are mechanically attached.

In another embodiment, the strip utilized as an attachment stud may be made from alternative materials, including an expanded or perforated metal strip. Similarly, the width of the strip may vary, depending on the specific application, realizing that sufficient width should be provided to permit the strip to function as an attachment stud.

The use of welded wire maximizes the flow of concrete within the form by minimizing the restrictive surface area of the tie, providing a distinct working advantage during the placement of concrete. The strength of the welded wire and bent-strip design is sufficient to hold the form together under the extreme pressures of concrete placement, while introducing almost no tie material into the form cavity which might restrict the flow of concrete.

The welded wire ties may be constructed such that the horizontal and vertical wires are essentially co-planer, with a circular radius bend in one or both wires at the point of intersection. Thus the wires of the wire ties are essentially co-planer and the thickness of the wire, except at intersection points of horizontal and vertical wires, where the wire portion has a thickness of two wires.

The welded wire ties are conventionally welded at each intersection point of the horizontal and vertical wires. The steel strip, whether solid, galvanized, perforated, expanded or otherwise fabricated, can conventionally be continuously welded to the horizontal wire members at all points of contact therewith. In the embodiment wherein the strip itself is bent in the vertical plane at a right angle to align a surface of the strip in a parallel plane to the surface of the EPS form, it is possible and contemplated that the strip will be welded to the horizontal wire members on both planes.

While wire has been used in other concrete forming applications, the invention disclosed herein provides a unique combination of a welded wire grid with an attached steel strip, bent to both strengthen the assembly and provide for a secure, fire-resistant attachment surface for mechanically attaching wall finishes.

It is further to be understood that while this invention is described in terms of expanded polystyrene forms, any plastic or other material that can be suitably molded and provide desired insulating properties may be employed. The use of related polymeric materials for insulation and similar applications is known in the art.

The welded steel form tie of this invention offers more strength, improved concrete flow, and a larger, more secure attachment stud than other ties known in the art. In one embodiment the welded steel form tie is made of heavy-gauge galvanized steel wire welded together in at least 40 locations, including to the attachment stud, to ensure the structural integrity of each form. The ties in the 16 inch high waffle forms are in one embodiment a full 13 inches tall, and may in another embodiment be 21 inches tall in flat panel forms with a 24 inch height. Generous spacing of the steel wires within the welded steel tie virtually eliminates any obstruction to the flow of concrete in the insulating concrete forms of this invention, significantly improving the consolidation of the concrete and the speed of construction. This design also minimizes the vibration of the forms during concrete placement and stabilizes the entire wall. The insulating concrete form of this invention has a recessed attachment stud, forming a part of the welded steel form tie, which is 1-½" wide, and is clearly marked on both sides for the full height of the form. This recessed feature simplifies the application of synthetic stuccos and other bonded surface coatings. The ties are placed so that the attachment studs remain on center, such as on 6 or 12 inches centers, regardless of the direction in which the form is installed. The insulating concrete forms of this invention are thus reversible end-to-end. The ties are spaced to allow end-to-end reversibility, so that insulating concrete forms of this invention can be installed in any direction, while maintaining the structural integrity of the concrete posts and the alignment of the attachment studs. This feature also allows for the efficient pre-panelization or assembly of wall sections that can significantly speed the process of installation. The insulating concrete form further uses a tongue and groove design to permit the form to be wet-set, thereby allowing the form to be easily and speedily erected.

The combination of a tongue and groove on each panel of the insulating concrete form of this invention permits the forms to be reversible end-to-end, while providing continuous insulation. Forms which are butt fit without an interlocking means are susceptible to heat loss through cracks. By use of both a tongue and a groove on each panel, the insulation is thus continuous with no heat loss.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. An insulating concrete form, the form comprising:

first and second substantially opposing panels, each panel having a top surface, bottom surface, first end surface, second end surface, an exterior surface defining a wall and an interior surface for receiving concrete, with the first end surface and second end surface of the first panel and second panel having both a tongue and groove, disposed such that on the first end surface of the first panel the tongue is proximal the exterior surface and the groove proximal the interior surface, on the second end surface of the first panel the groove is proximal the exterior surface and the tongue proximal the interior surface, on the first end surface of the second panel the groove is proximal the exterior surface and the tongue proximal the interior surface, on the second end surface of the second panel the tongue is proximal the exterior surface and the groove proximal the interior surface, the panels disposed such that the first end surface of the first panel opposes the first end surface of the second panel and the second end surface of the first panel opposes the second end surface of the second panel; and at least two ties interconnecting the first panel and the second panel, each of said ties comprising at least three vertical and at least three horizontal wires attached at each intersection between the vertical and horizontal wires and arranged to form a grid and metal strips welded to the horizontal wires adjacent the opposite ends thereof and arranged perpendicular to the grid plane and embedded within the panel;

whereby two or more forms may be horizontally positioned and interlocked to form a planar surface by means of a joint formed by both a tongue and a groove on each panel of one form interconnecting with a groove and a tongue on each panel of another form, the forms being reversibly connectable such that the first end surface of the first and second panels of one form may be joined with either the first end surface or the second end surface of the first and second panels of another form.

2. The form of claim 1, wherein the top surface of each of the first and second panel having a tongue or a groove, and the bottom surface of the first and second panel having a complementary tongue or groove, whereby two or more forms may be vertically stacked and interlocked to form a planar surface by means of a joint formed by a single tongue on each panel of one form interconnecting with a single groove on each panel of another form.

3. The form of claim 1 wherein the panels comprise a polymeric material.

4. The form of claim 1 wherein the exterior surfaces of the first panel and second panel each form a single plane.

5. The form of claim 1 wherein the exterior surface of at east the first panel forms two planes, the two planes intersecting at an angle to form a vertical line.

6. The form of claim 5 wherein the angle is a right angle or a forty-five degree angle.

7. The form of claim 1 wherein the tie comprises a welded wire tie.

8. The form of claim 7 wherein said at least three parallel horizontal wires are arranged in a single plane, said wires spaced apart such that the total distance from the bottom-most horizontal wire to the top-most horizontal wire is less than the height of the two opposing panels, each horizontal wire being of a length greater than the distance between the exterior surfaces of the two opposing panels, with a right angle bend on each end of each horizontal wire positioned such that each right angle bend is disposed between the exterior surface and the interior surface of a panel;

at least three parallel vertical wires arranged in a single plane, the wires spaced apart and arranged so as to be disposed within a distance less than the distance between the right angle bends on each end of the horizontal wires, each wire being a length at least equal to the total distance from the bottom-most horizontal wire to the top-most horizontal wire;

the at least three horizontal wires and at least three vertical wires disposed such that each horizontal wire touches and forms a right angle intersection with all vertical wires, and each vertical wire touches and forms a right angle intersection with all horizontal wires, the wires being welded one to the other at each intersection; and each of said metal strips disposed within the interior of said right angle bend on each end of the horizontal wires, at least a portion of each of the metal strips being substantially parallel to the exterior surface of the panel, each metal strip being in contact with each horizontal wire and welded thereto.

* * * * *